US006230471B1

(12) United States Patent
Robertson et al.

(10) Patent No.: US 6,230,471 B1
(45) **Date of Patent: *May 15, 2001**

(54) METHOD AND APPARATUS FOR PROCESSING ENVELOPES CONTAINING CONTENTS

(75) Inventors: James G. Robertson, Braddock; Michael E. York, Cinnaminson; Eric P. Minbiole, Maple Shade; Robert R. Dewitt, Marlton; George L. Hayduchok, Mount Holly, all of NJ (US); Glen J. VanSant, Langhorne, PA (US)

(73) Assignee: Opex Corporation, Moorestown, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/870,521

(22) Filed: Jun. 6, 1997

(51) Int. Cl.[7] ..... B65B 57/00

(52) U.S. Cl. ..... 53/52; 53/381.3; 53/492; 83/912

(58) Field of Search ..... 83/13, 912; 53/381.3, 53/381.2, 52, 492; 271/107; 414/798.3

(56) References Cited

U.S. PATENT DOCUMENTS

| | | | |
|---|---|---|---|
| D. 277,624 | 2/1985 | Stevens et al. | D6/422 |
| D. 317,089 | 5/1991 | Coleman et al. | D6/422 |
| D. 320,904 | 10/1991 | Coleman et al. | D6/511 |
| 3,979,884 | 9/1976 | Russell | 53/381 R |
| 4,124,968 | 11/1978 | Stevens | 53/381 R |
| 4,353,197 | 10/1982 | Stevens | 53/492 |
| 4,649,694 | 3/1987 | Haley | 53/381 R |
| 4,934,892 | 6/1990 | Smith et al. | 414/412 |
| 5,028,900 | 7/1991 | DeWitt | 335/228 |
| 5,036,190 | 7/1991 | Lile | 250/223 R |
| 5,052,168 | 10/1991 | DeWitt . | |
| 5,134,834 | 8/1992 | Hayduchok . | |
| 5,156,515 | 10/1992 | Charron et al. . | |
| 5,328,164 | 7/1994 | Soga . | |
| 5,440,861 | 8/1995 | Lund . | |

FOREIGN PATENT DOCUMENTS

| | | |
|---|---|---|
| 0655978 | 6/1996 | (EP) . |

*Primary Examiner*—M. Rachuba
(74) *Attorney, Agent, or Firm*—Dann, Dorfman, Herrell and Skillman; Stephen H. Eland

(57) ABSTRACT

A method and apparatus for processing mail is provided. Mail is placed into an input bin having a conveyor that conveys the mail towards a feeder. The feeder serially feeds the envelopes by engaging the lead envelope in the stack of mail and displacing the lead envelope transverse the stack of mail. The mail is fed into a shuttle that vertically displaces the envelopes to position the envelopes for entering a justifier. The justifier justifies the top edge of the envelopes and conveys the envelopes to a cutter that severs the top edge of the envelopes. A transport conveys the envelopes from the top cutter to an extractor. The extractor opens the edge-severed mail and presents the contents of the envelopes to an operator who manually extracts the contents. The transport conveys the empty envelopes from the extractor to a verifier that verifies that all of the contents have been removed from the envelope before the envelope is discarded. The transport is vertically adjustable, and a vertical drive motor is provided to vertically adjust the conveyor.

17 Claims, 12 Drawing Sheets

METHOD AND APPARATUS FOR PROCESSING ENVELOPES CONTAINING CONTENTS

FIELD OF THE INVENTION

The present invention relates to the field of processing mail. More specifically, the present invention relates to a workstation operable to process envelopes containing contents by presenting opened envelopes to an operator so the operator can extract the contents from the envelopes.

BACKGROUND OF THE INVENTION

Automated and semi-automated machines have been employed for processing documents such as bulk mail. Due to the large quantity of mail received by many companies, there has long been a need for efficient sorting of incoming mail. Document sorting has become particularly important in the area of remittance processing.

Utility companies, phone companies, and credit card companies routinely receive thousands of payment envelopes from their customers on a daily basis. Typically, a customer payment envelope contains an invoice stub and some type of customer payment, usually in the form of a bank check or money order.

Frequently, the envelopes received in the incoming mail have varying characteristics. For instance, the height, length and thickness of the envelopes may vary. In addition, the opacity of the envelopes may vary significantly due to the differences between standard envelopes and privacy envelopes commonly used for financial documents.

In accordance with the present invention, an apparatus and method are provided for processing mail that can accommodate a batch of mail containing envelopes having different characteristics.

SUMMARY OF THE INVENTION

A workstation is provided for processing a stack of mail including envelopes having contents. The envelopes are serially fed from an input bin into an envelope path. One or two of the edges of the envelopes are severed and the envelopes are presented to an operator who manually extracts the contents from the envelopes.

The workstation incorporates a feeder having a feed arm pivotal between first and second positions. During operation, the feed arm engages the lead envelope in the stack of envelopes and displaces the lead envelope transverse the stack of envelopes.

After the envelopes are fed into the envelope path, the top edge of each envelope is vertically adjusted. After the top edge is vertically adjusted, the top edge of each envelope is justified. A transport then conveys each envelope to an extractor. A drive mechanism is operable to vertically displace the transport.

The extractor includes two opposing extracting arms pivotal between an open position and a closed position. Each arm includes an engagement end for engaging an envelope. The extractor arms are maintained in the open position for a delay period, and the distance between the engagement ends of the extractor arms in the open position is variable.

The workstation is operable to automatically advance an envelope away from the extractor after the operator removes the contents from the envelope. In a preferred mode, the thickness of the envelope at the extractor is continuously detected. As envelopes in the stack of mail are processed, the thickness of each successive envelope is compared against a thickness standard based on the average thickness of the previous empty envelopes in the stack of mail. If the detected thickness is below a thickness threshold, the envelope is assumed to be empty and is transported away from the extractor.

DESCRIPTION OF DRAWINGS

The foregoing summary, as well as the following detailed description of the preferred embodiments of the present invention, will be better understood when read in conjunction with the accompanying drawings, in which.

DETAILED DESCRIPTION OF THE PREFERRED EMBODIMENT

Figures 1, 1A:
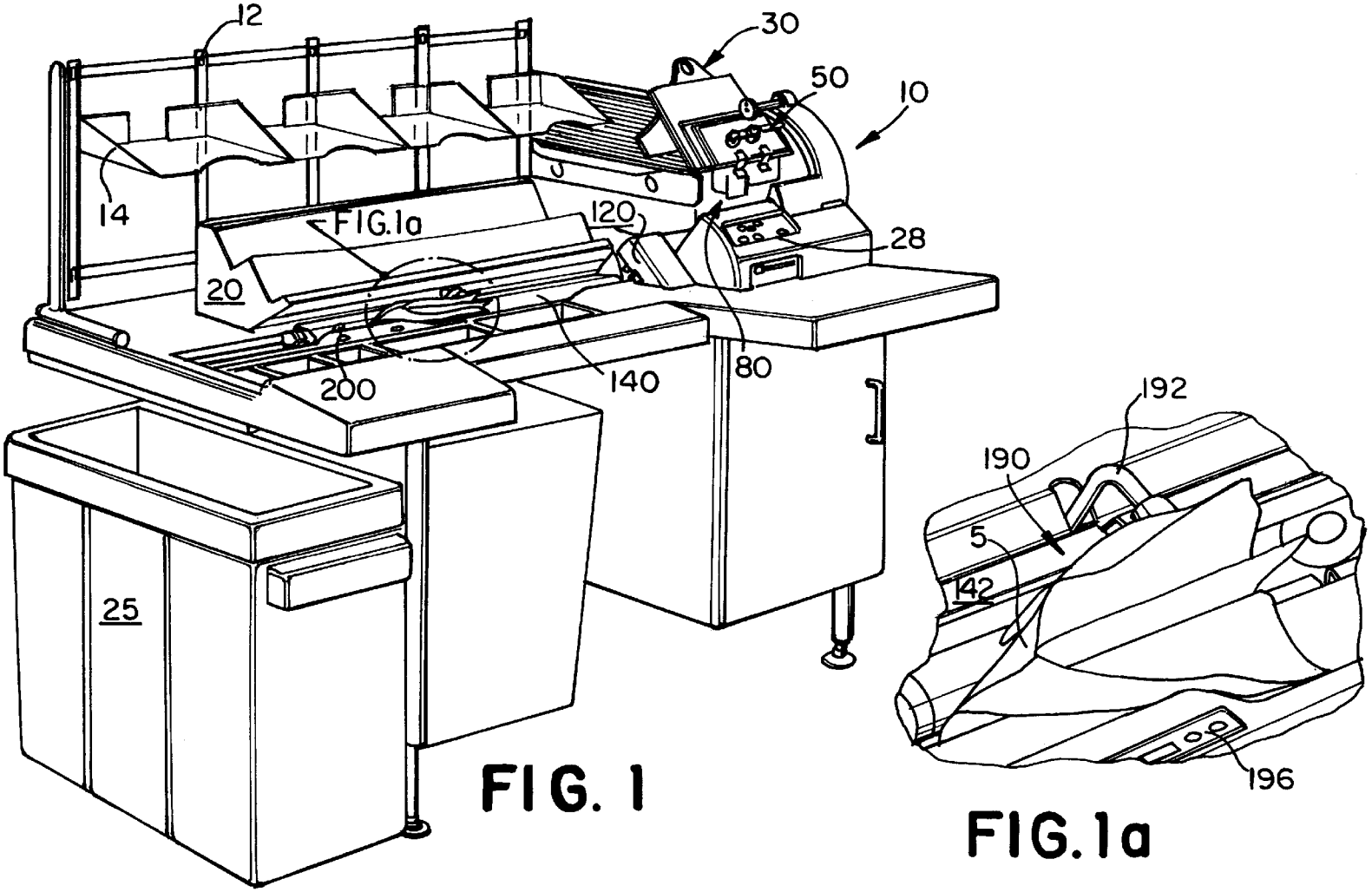
FIG. 1 is a perspective view of a semi-automated mail processing station in accordance with the present invention.
FIG. 1*a* is an enlarged perspective view of the portion of the device shown in FIG. 1 bounded by circle A.

Referring now to the figures in general and to FIG. 1 in particular, a semi-automated mail processing workstation 10 is illustrated. The workstation 10 processes mail by severing one or two edges of each envelope in a stack of mail, and presenting the edge-severed envelopes one at the time to an operator who removes the documents from the envelope by hand. The operator can then manually reorient and sort the documents as necessary. After the operator removes the documents from an envelope, the envelope is transported to a waste container 25.

A general overview of the flow of mail is as follows. Initially, a stack of envelopes containing documents, referred to as a job, is placed into an input bin 30. A motor-driven pusher 35 supports the envelopes and advances the envelopes toward the front end of the input bin 30. A feeder 50 removes the lead envelope 5 from the front of the stack and transfers the envelope to a feed tray 80.

The envelope 5 in the feed tray 80 is edge-justified by a plurality of opposing rollers. From the feed tray 80, the envelope 5 drops into a side cutter 90 (shown in FIG. 5), which severs the side edge of the envelope if desired. From the side cutter, the envelope drops into a shuttle 100 (shown in FIG. 5). The shuttle moves vertically to adjust the height of the top edge of the envelope to account for variations in the height of the different envelopes in the job. The shuttle moves vertically until the height of the top edge of the envelope 5 is within an acceptable range for advancing the envelope into a top cutter 120. The envelope is then transported to the top cutter, which severs the top edge of the envelope 5.

From the top cutter 120, the envelope enters the main transport 140. The envelope 5 pauses at a staging area on the first half of the main transport 140. The main transport then advances the envelope to an extractor 190. The extractor 190 pulls apart the front and back faces of the envelope to present the contents of the envelope for removal. An operator then manually removes the contents from the envelope 5. The operator can then sort and reorient the contents if desired. A plurality of bins are provided in front of the main transport 140, as well as a plurality of adjustable shelves 14 mounted on a rack 12 behind the main transport 140. In addition, a sawtooth shelving unit 20 is provided for receiving documents.

After the operator removes the documents from the envelope 5, the apparatus 10 automatically advances the envelope to a verifier 200. The verifier 200 verifies that all of the documents were removed from the envelope before the envelope is discarded. From the verifier 200 the main transport 140 conveys the envelope into a waste container 25.

A controller controls the processing of the envelopes in response to signals received from various sensors at various locations of the workstation 10 and in response to parameters set for the job by the operator. For instance, in response to an indication from a sensor in the feed tray 80 that there is no envelope in the feed tray, the controller sends a signal to the feeder 50 indicating that an envelope should be fed from the input bin 30 to the feed tray 80. Similarly, in response to an indication from a sensor in the shuttle 100 that there is no envelope in the shuttle, the controller sends a signal to the feed tray 80 indicating that an envelope should be dropped from the feed tray into the shuttle.

The workstation is divided into six functionally separate sections: the input bin 30, the feeder 50, the shuttle 100, a staging area on the main transport 140, the extractor 190, and the verifier 200. In most cases, the controller controls the operation of the six sections independently from each other. In other words, a signal from the shuttle that there is no envelope in the shuttle does not cause the controller to send both a signal to feed tray 80 indicating that an envelope should be dropped and a signal to the feeder 50 indicating that an envelope should be fed to the feed tray. Instead, in response to the shuttle empty signal, the controller sends a signal to the feed tray 80 indicating that an envelope should be dropped. After the envelope is dropped, a sensor in the feed tray sends a signal to the controller indicating that there is no envelope in the feed tray. The controller will then send a signal to the feeder 50 indicating that an envelope should be fed to the feed tray. This independence allows several operations to proceed simultaneously or asynchronously as required. As a result, a slow down in one section does not necessarily slow down all of the other sections.

Input Bin

Figure 2:
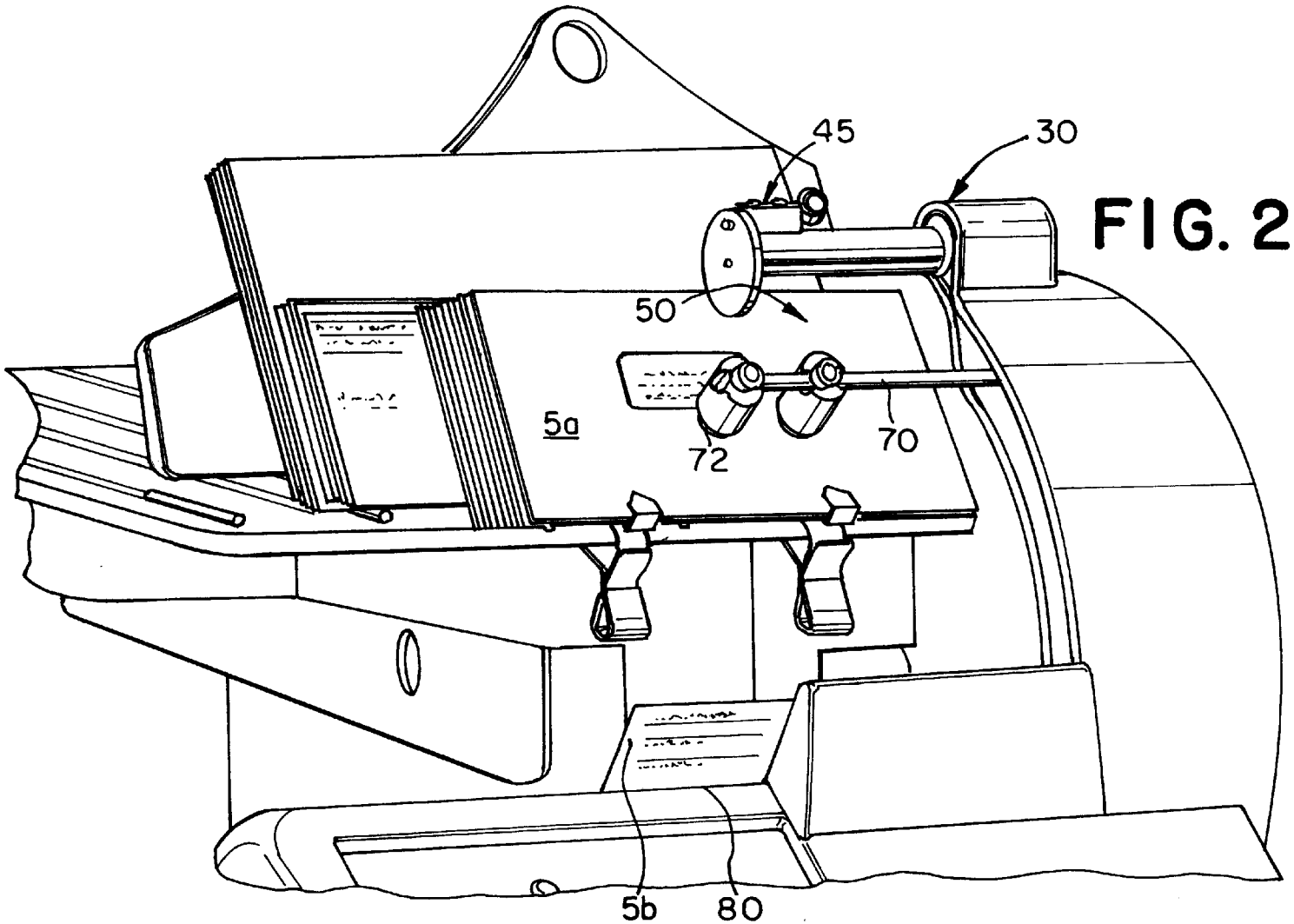
FIG. 2 is an enlarged fragmentary perspective view of the feeder and input bin of the device shown in FIG. 1.
Figure 3:
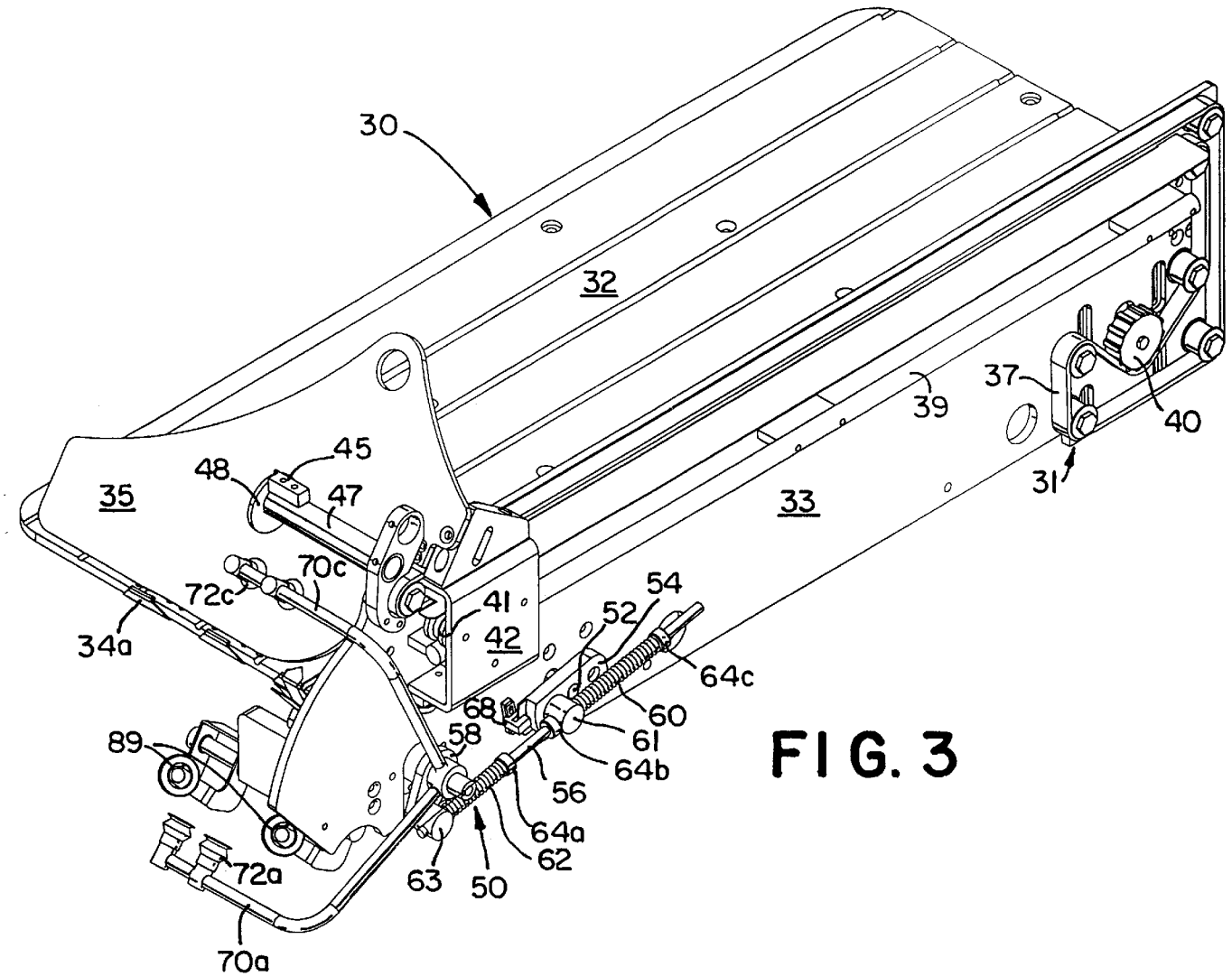
FIG. 3 is an enlarged fragmentary perspective view of the feeder and input bin of the device in FIG. 1, shown with covers removed.
Figure 4:
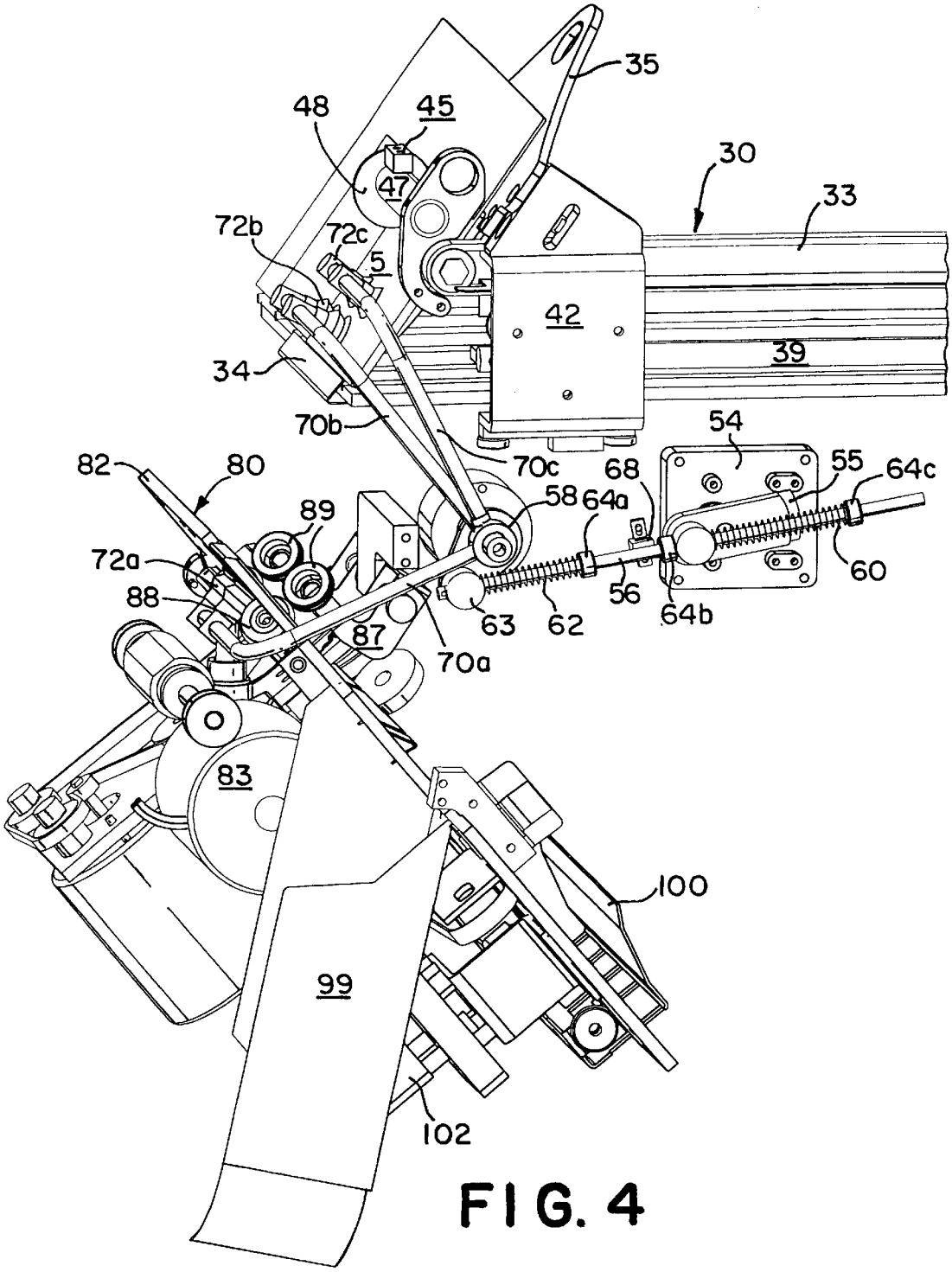
FIG. 4 is an enlarged fragmentary perspective view of the input bin and feeder of the device in FIG. 1, illustrating the operation of the feeder.

The operation of the input bin 30 can best be seen by reference to FIGS. 2–4. The function of the input bin 30 is to keep the stack of mail lightly pressed against a switch 45 at the front end of the input bin.

The input bin 30 includes a generally planar base plate 32 and a transverse sidewall 33. A stack of mail is placed into the input bin so that the longer edges of the envelopes are against the base plate, and the shorter sides of the envelopes are against the sidewall 33. A conveyor 31 drives the stack of mail forward to keep the stack of mail lightly pressed against a retaining lip 34 and a switch 45 at the front end of the input bin. The retaining lip is preferably continuous as shown in FIG. 4. Alternatively, the retaining lip can be made from a series of clips 34*a* as shown in FIG. 3.

The conveyor 31 includes a pusher 35 that supports the rearward end of the stack of mail. A bracket 42 connected to the pusher has a plurality of rollers so that the bracket can roll along a guide bar 39. The conveyor includes a drive wheel 40 that is driven by a pusher motor (not shown). The drive wheel 40 drives a pusher belt 37 which in turn drives the pusher bracket 42 along the guide rail 39 to advance the pusher 35 to keep the stack of mail lightly pressed against the switch 45.

The switch 45 is mounted on a mounting arm 47 that projects from the sidewall out over the base plate 32. A disc shaped pendulum 48 is pivotally mounted to the end of the mounting arm 47. As can be best seen in FIG. 6, the pendulum 48 has an aperture 49. A reflective sensor in the arm 47 is directed toward the pendulum 48. When the stack of envelopes is sufficiently advanced, the stack presses against the pendulum 48, pivoting the pendulum so that the beam of the reflective sensor in the arm is not aligned with the aperture 49 in the pendulum. If the stack of mail does not depress the pendulum 48, the aperture 49 in the pendulum aligns with the beam in the reflective sensor indicating that the switch 45 is not depressed.

During operation, whenever the switch 45 is not depressed, a signal is sent to the controller indicating that the envelopes need to be advanced. The controller then sends a signal to the conveyor 31 to advance the stack of mail until the switch 45 is depressed. In the present instance, there is an exception to this, in that the conveyor 31 does not advance the mail while the feeder 50 is running. This prevents the movement of the conveyor 31 from interfering with the operation of the feed arm 70. If the mail does not depress the switch 45 within a set period of time after the conveyor 31 starts, the controller assumes that a jam has occurred or that the bin is empty. The conveyor is stopped and a message appears on an LCD display (not shown) indicating that there is a jam in the input bin 30.

Feeder

As shown in FIG. 2, a feeder 50 feeds the envelopes from the input bin 30 to the feed tray 80. In FIG. 2, the lead envelope in the input bin is designated 5*a*, and the envelope in the feed tray 80 is designated 5*b*. A feed sensor 85 in the feed tray 80 (see FIG. 5) detects the presence of an envelope in the feed tray. During operation, if there is no envelope in the feed tray 80, the feed sensor 85 sends a signal to the controller indicating that there is no envelope in the feed tray. The controller in turn sends a signal to the feeder 50 indicating that an envelope should be fed from the input bin 30 to the feed tray 80. The feeder 50 then attempts to feed an envelope from the input bin 30 to the feed tray 80. If the feed sensor 85 does not detect the presence of an envelope within a certain period of time, the controller assumes that a jam has occurred and a message appears on the LCD display indicating that there is a jam in the feeder.

Figure 5:
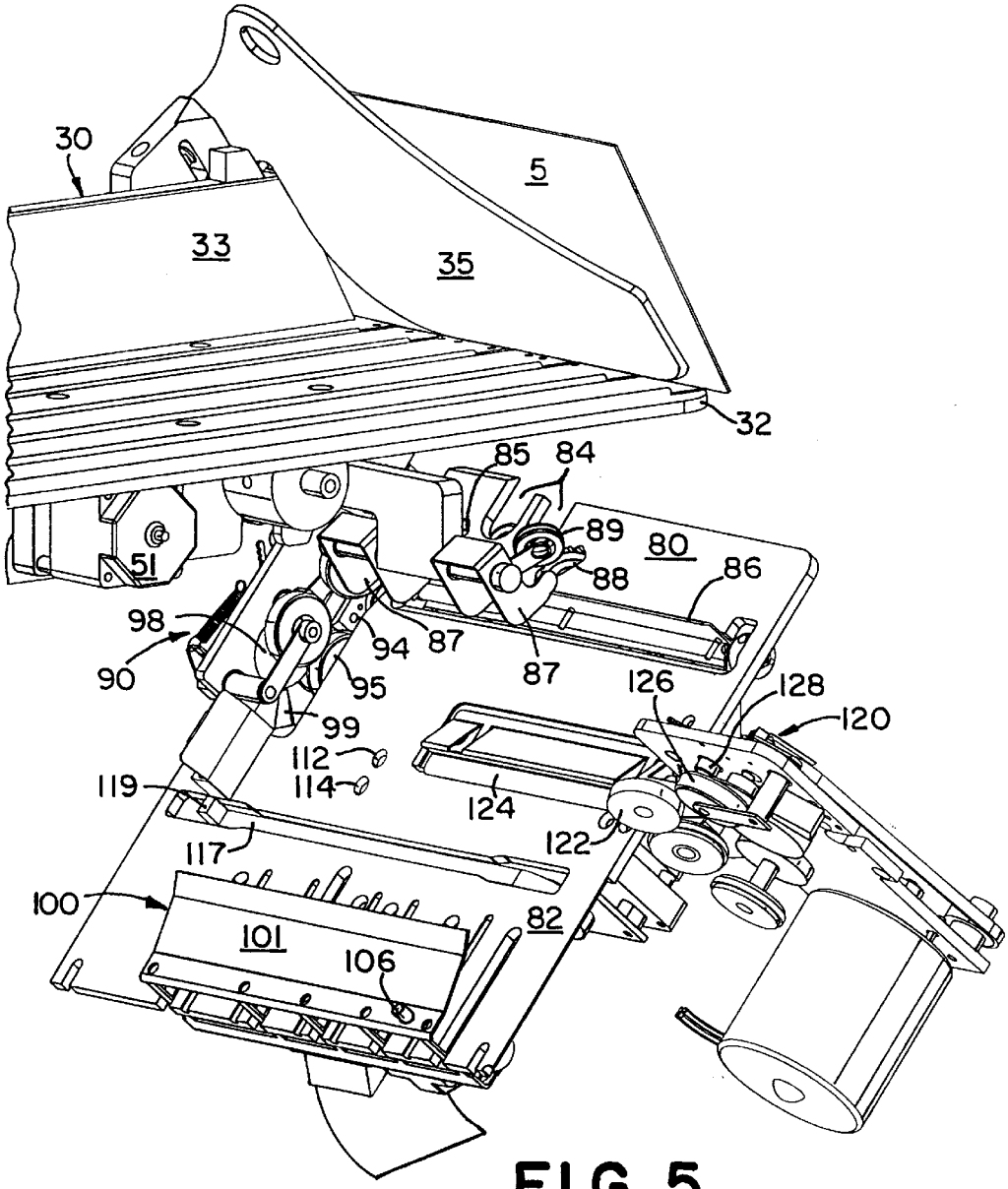
FIG. 5 is an enlarged fragmentary perspective view of the input bin and shuttle of the device shown in FIG. 1.

Referring to FIGS. 3–5, the feeder 50 includes a motor 51 that drives a feed arm 70. A pair of vacuum suction cups 72 are mounted on the feed arm 70. A series of linkage bars 54, 56, 58 transmit the power from the feed motor 51 to the feed arm 70 and control the range of movement of the feed arm.

The workstation can utilize a feeder that pulls the lead envelope axially off of the stack of mail. However, when an envelope is pulled axially, a suction is created that tends to pull along the envelope behind the lead envelope in the mail stack. This suction can cause the feeder to feed two envelopes which will cause a jam in the flow of the envelopes. Therefore, in the present instance, the feeder 50 displaces the lead envelope transversely to shear the envelope from the stack of mail.

FIG. 4 illustrates the operation of the feeder 50, showing the feed arm 70 in three different positions. In the first position, the feed arm and suction cups are designated 70*a* and 72*a*; in the second position the feed arm and suction cup are designated 70*b* and 72*b*; and in the third position the feed arm and suction cups are designated 70*c* and 72*c*. In the first position, the feed arm 70*c* is adjacent the feed tray 80. This position is referred to as the home position, and corresponds to the position at which the feed arm stops after feeding an envelope into the feed tray 80.

From the home position, the feed arm 70 rotates upwardly toward the input bin 30. As the feed arm rotates upwardly, a pump provides negative pressure to the suction cups 72. In the second position, the two vacuum suction cups 72*b* engage the lead envelope 5 in the input bin 30. The suction cups are bellows-shaped, and the negative pressure causes the suction cups to collapse when they engage the lead envelope. When the suction cups collapse, the lead envelope is pulled axially forward relative to the stack of mail.

The feed arm continues to rotate upwardly, displacing the lead envelope upwardly, transverse the stack of mail. In the third position, the feed arm 70*c* is at its uppermost position, and the arm has vertically displaced the envelope so that the lower edge of the envelope is higher than the retaining lip 34. From the third position, the arm pivots downwardly, returning to the home position to feed the envelope into the feed tray. As the feed arm pivots downwardly with the envelope, the envelope clears the retaining lip 34 because of the axial displacement caused by the collapse of the suction cups 72. Once the feed arm returns to the home position the negative pressure to the suction cups is shut-off releasing the envelope from the suction cups and into the feed tray 80.

The linkage that transmits the power from the feeder motor to the feed arm 70 is best seen in FIG. 4. The feeder motor 51 (shown in FIG. 5) drives a crank arm 54. The crank arm is pivotally connected to a connecting rod 56. The connecting rod in turn is pivotally connected to a drive arm 58 that drives the feed arm 70. The linkage is shown in its forward-most position in FIG. 4, which corresponds to the feed arm being in its uppermost position designated 70*c*, i.e. the third position described above. A feed arm home sensor 68 detects when the feed arm 70 is in the home position under ordinary operating conditions. A tongue 55 on the end of the crank arm 54 cooperates with the feed arm home sensor 68. In this way, when the tongue 55 enters the feed arm home sensor 68, the sensor sends a signal to the controller indicating that the feed arm 70 is in the home position.

Preferably, the linkage is provided with overload couplings to prevent injury in the event that an operator's hand or arm gets caught in between the feed arm 70 and the feed tray 80 or the feed arm and the stack of mail. Therefore, the connecting rod 56 is slidably connected to the crank arm 54 and the drive arm 58. As shown in FIG. 4, the connecting rod 56 extends through a crank mounting collar 61 that is pivotally connected to the crank arm 54. Similarly, the forward end of the connecting rod 56 extends through a drive mounting collar 63 that is pivotally connected to the drive arm 58. The connecting rod 56 is slidably displaceable through both of the mounting collars 61, 63 so that the length of the connecting rod between the crank arm 54 and the drive arm 58 is variable. A feed overload spring 60 bears against the crank mounting collar 61 and a locking collar 64*c* that is fixed to the connecting rod 56. A return overload spring 62 bears against the drive mounting collar 63 and a second locking collar 64*a*. In addition, a third locking collar 64*b* fixed to the connecting rod limits the rearward sliding of the connecting rod relative to the crank mounting collar 63.

Under normal operating conditions, the springs 60, 62 bias the connecting rod 56 to maintain the length of the connecting rod between the crank arm 54 and the drive arm 58 at a constant operating length. However, if the feed arm is restrained, the connecting rod slides relative to the crank arm and the drive arm so that the feeder motor can continue to drive without driving the feed arm 70. If the feed arm is restrained to create an overload condition when the feed arm is travelling upwardly, the drive arm overcomes the bias of the feed overload spring 60 and the connecting rod slides forward through the drive mounting collar 63. Conversely, if the feed arm is restrained to create an overload condition when the feed arm is travelling downwardly, the crank arm overcomes the bias of the return overload spring 62 and the connecting rod slides rearwardly through the crank mounting collar 61. As long as the feed arm 70 is restrained to create an overload condition, the crank arm 54 will continue to rotate and the connecting rod will continue to slide back and forth through the crank mounting collar 61 and the drive mounting collar 63.

Figure 6:
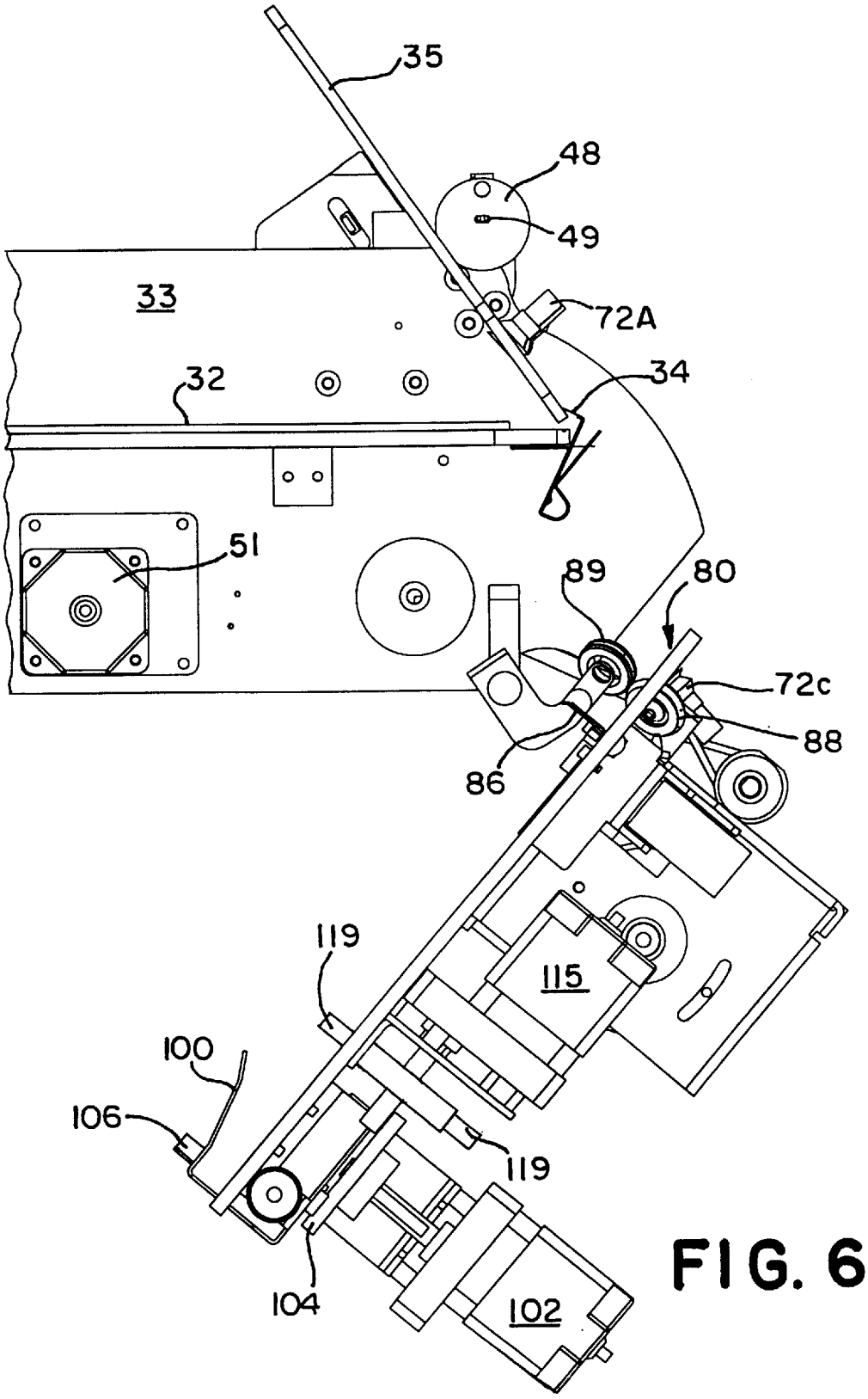
FIG. 6 is an enlarged fragmentary side elevational view of the input bin and shuttle shown in FIG. 5.

Referring now to FIGS. 5 and 6, when the feeder feeds an envelope into the feed tray 80, the bottom edge of the envelope in the feed tray 80 rests against a gate 86 that keeps the envelope from dropping down into the shuttle 100. A side justifier justifies the envelope against a side fence 94. Optionally, a retractable stop pin can be used to prevent the envelope from contacting the side fence. Before an envelope is fed to the feed tray 80, the pin is advanced to project from the surface of the feed tray. The envelope is then side-justified against the pin. When the envelope is dropped from the feed tray, the pin retracts so that the envelope is justified against the side fence 94.

The side justifier includes a pair of idler rollers 89 angled toward the side fence 94, and a pair of opposing drive rollers 88 driven by a motor 83 (see FIG. 4). The idler rollers are mounted on biased mounting arms 87 that bias the idler rollers 89 toward the drive rollers 88. The feeder 50 feeds the envelopes into the feed tray 80 so that each envelope is inserted between the drive rollers 88 and the idler rollers 89. A continuously running justifier motor 83 operates to justify the envelope against the side fence 94.

The gate 86 pivots between open and closed positions. A solenoid actuated arm (not shown) extends and retracts to pivot the gate between the open and closed positions. In the closed position (shown in FIGS. 5 and 6), the gate supports the lower edge of the envelope. In the open position, the gate is pivoted downwardly into a recess in the feed tray, allowing the envelope in the feed tray to drop into a side cutter 90. The operation of the gate 86 is controlled by the controller. In response to an indication from a shuttle sensor 106 that there is no envelope in the shuttle 100, the controller sends a signal to open the gate so that the envelope in the feed tray drops into the side cutter 90.

The side cutter 90 can be seen best in FIG. 5. The side cutter includes a plurality of drive rollers 95 and opposing idlers rollers 96. As the envelope passes between the rollers a rotary knife 98 severs the side edge of the envelope. The severed edge drops down a scrap chute 99 into a waste container.

A build-up of scraps in the scrap chute 99 can interfere with the operation of the side cutter causing a jam. Therefore a sensor (not shown) in the scrap chute monitors the scraps in the scrap chute. If the sensor detects a build-up of scraps, a signal is sent to the controller indicating a build-up and the operation of the workstation is shut down. A message on the LCD display prompts the operator to clear the scrap chute 99. The operation of the workstation resumes after the operator clears the scrap chute 99.

The amount of envelope the side cutter 90 severs depends upon the position of the side fence 94. The side fence 94 position can be infinitely adjustable, however, the side fence preferably has three positions: a standard position, a thick-cut position and a no-cut position. For most applications, the side fence 94 is set to the standard position so that the side cutter severs a relatively thin strip of the envelope. In the thick-cut position, the fence is moved toward the side cutter (from right to left from the perspective of FIG. 5), so that the side cutter removes a relatively thick strip (about ½") of the envelope. In the no-cut position, the side fence 94 is moved away from the side cutter (from left to right from the perspective of FIG. 5), so that the side cutter does not cut the envelope. From the side cutter 90, the envelope drops into the shuttle 100.

Shuttle

Referring again to FIGS. 5 and 6 the shuttle 100 can be seen most clearly. The shuttle 100 operates to vertically adjust the envelope so that the location of the top edge is located within a predetermined range. The shuttle adjusts the position of the envelope so the envelope is at the proper position to be severed by a top cutter 120. Prior to entering the top cutter 120, a top justifier 122 justifies the top edge of the envelope against an upper stop 124. In order for the justifier to justify the envelope against the upper stop 124, the vertical position of the upper envelope must fall within a set range. If the top edge is below the operating range, the rollers of the justifier will not properly engage the envelope and the envelope will either jam in the top cutter 120 or pass below the top cutter. If the top edge is above the operating range, the envelope will jam in the top cutter 120.

The shuttle 100 includes a shuttle bin 101 that receives the envelope after the envelope drops from the side cutter 90. The envelope rests in the bin against a generally flat plate 82 referred to as the side transport plate. Preferably, the side transport plate is generally parallel to the envelope path through the main transport 140 (shown in FIG. 7*a*). A vertical drive motor 102 drives the shuttle vertically. A pinion driven by the vertical drive motor 102 cooperates with a rack 104 connected to the shuttle bin 101 to adjust the shuttle bin vertically.

The vertical displacement of the shuttle is controlled by the controller in response to signals received from an upper justification sensor 112 and a lower justification sensor 114. The envelope is properly positioned if the top edge of the envelope is between the upper and lower sensors 112, 114. Therefore, if the upper sensor 112 does not detect an envelope and the lower sensor 114 indicates an envelope, the envelope is properly positioned and the shuttle does not adjust vertically. If both the upper and lower sensors detect the envelope, then the envelope is too high and the shuttle adjusts downwardly until the upper sensor does not detect the envelope. Conversely, if both the upper and lower sensors do not detect the envelope, then the envelope is too low and the shuttle adjusts upwardly until the lower sensor detects the envelope.

After the envelope is adjusted vertically, the envelope remains in the shuttle bin 101 until the controller receives an indication from a sensor in the staging area on the main transport that there is no envelope in the staging area. In response to this indication, a cleat belt 117 transports the envelope horizontally toward the top cutter 120. The cleat belt has at least one, and preferably two cleats 119 that protrude from the surface of the cleat belt 117. A horizontal drive motor 115 drives the cleat belt 117. The cleat 119 engages the trailing edge of the envelope in the shuttle bin 101. As the cleat belt 117 advances, the cleat 119 drives the envelope in the shuttle bin 101 toward the top cutter 120, transporting the envelope from the shuttle bin.

The shuttle 100 operates in two modes: fixed height mode and variable height mode. The operator selects the shuttle mode prior to processing a job based on the characteristics of the mail in the job.

In the variable height mode, the height of the envelopes in the job vary. Therefore, the vertical adjustment of the shuttle between successive envelopes may be fairly significant. To decrease the overall response time of the shuttle, the height of each envelope is measured before each envelope enters the shuttle. Based on the height of the envelope entering the shuttle, the shuttle adjusts vertically before the envelope enters the shuttle. This operates as a rough adjustment approximating the proper position of the shuttle.

The operation of the shuttle in variable height mode is as follows. After the shuttle 100 conveys an envelope out of the shuttle bin 101 and into the top cutter 120, the shuttle adjusts the height of the shuttle bin to a home position. Preferably, the home position corresponds to a minimum height, which is the height of the shortest piece of mail that the workstation can process. As the next envelope is dropping from the feed tray 80, the feed sensor 85 detects the height of the envelope. If the height of the envelope is greater than the minimum height, the controller determines the distance that the shuttle should be moved based on the height of the envelope. Based on this distance determination, the shuttle bin is adjusted downwardly.

When the envelope arrives in the shuttle bin 101, the shuttle bin should be at approximately the proper height. If the top edge of the envelope is between the upper and lower justification sensors 112, 114, then the shuttle is at the proper height. If the top edge is not between the sensors, then the shuttle is adjusted vertically in response to the sensors as described above. If the shuttle overshoots while trying to adjust the location of the top edge of the envelope, (i.e. goes from too high to too low) the shuttle will continue to adjust the height of the shuttle bin until the envelope is properly justified. If the shuttle does not properly justify the envelope within a predetermined time, the controller determines that a jam has occurred and a message appears on the LCD display screen indicating a jam in the shuttle.

In the fixed height mode, the envelopes in a job are generally the same height, so that the vertical adjustment of the shuttle between successive envelopes is generally minimal. Therefore, the height of the shuttle bin 101 need not be adjusted individually for each envelope before the envelope enters the bin. Because successive envelopes are approximately the same height, the shuttle bin 101 does not return to the home position after an envelope is conveyed out of the shuttle. Instead, the shuttle bin stays in the same position after conveying an envelope to the top cutter 120. Then, after the next envelope arrives in the shuttle bin from the feed tray 80, the shuttle adjusts for the minor variations among envelopes using the upper and lower justification sensors 112, 114 as described above.

The workstation will operate in fixed height mode or variable height mode regardless of whether the mail is fixed height or variable height. However, the performance of the workstation is optimized if the proper mode is selected. For example, if uniform mail is processed in varying height mode, the shuttle bin will move to the home position before each piece, and then move down to accommodate the height of the piece. This repeated motion is unnecessary because the shuttle bin could stay at the same position. On the other hand, if varying height mail is processed in a fixed height mode, the height of the shuttle bin is not adjusted until after an envelope arrives. When the envelope arrives, all of the adjustment must be made using the upper and lower justification sensors 112, 114. Therefore, the time to adjust the shuttle bin is unnecessarily lengthened, which can slow down the continued processing of the envelopes.

From the shuttle, the envelope enters the top justifier 122. The top justifier 122 justifies the top edge of the envelope against the upper stop 124. The upper stop has a shoulder that acts as a stop for justifying the envelopes. The stop 124 is tapered to create a ramp so that the envelopes can pass over the shoulder of the stop as they drop from the feed tray 80 to the shuttle bin 101.

From the top justifier 126 the envelope passes through a top cutter 120, which is a rotary cutter similar to the side cutter 90 described above. From the top cutter 120, the envelope is conveyed to the staging area 155 on the main transport 140.

Staging Area

The staging area 155 is essentially a waiting area for envelopes on the main transport. The staging area operates to reduce the time the operator must wait for the next envelope to be advanced to the extractor after the contents in an envelope are extracted. Without the staging area 155, the operator must wait for an envelope to be conveyed from the shuttle 100 to the extractor 190. By including the staging area 155 the operator need only wait for the envelope to be conveyed from the staging area to the extractor.

Figure 7B:
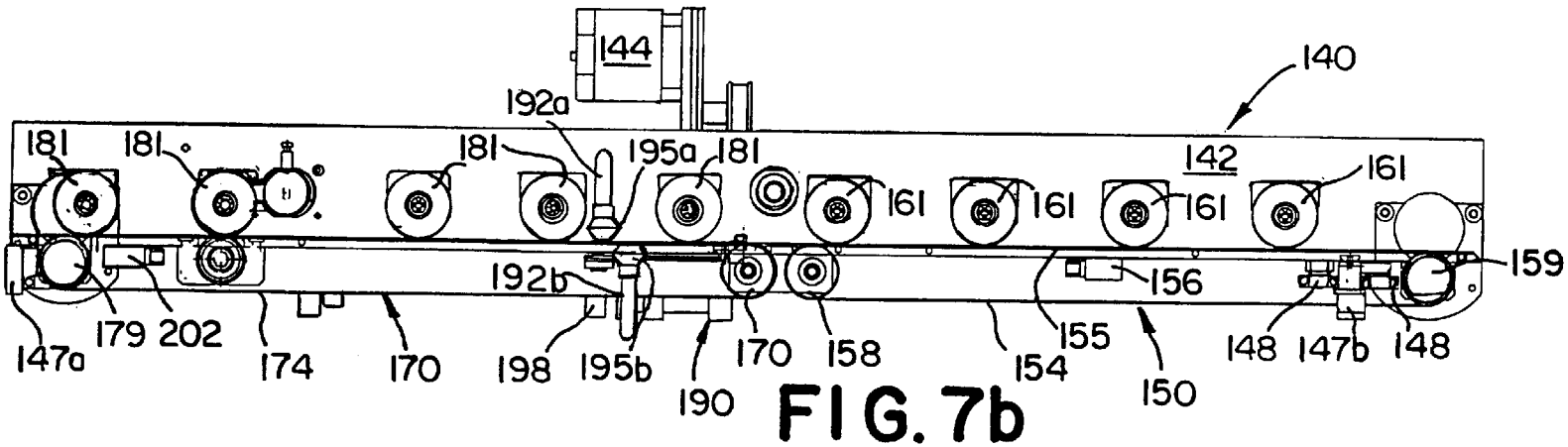
FIG. 7*b* is a plan view of the main transport illustrated in FIG. 7*a;*
Figure 7A:
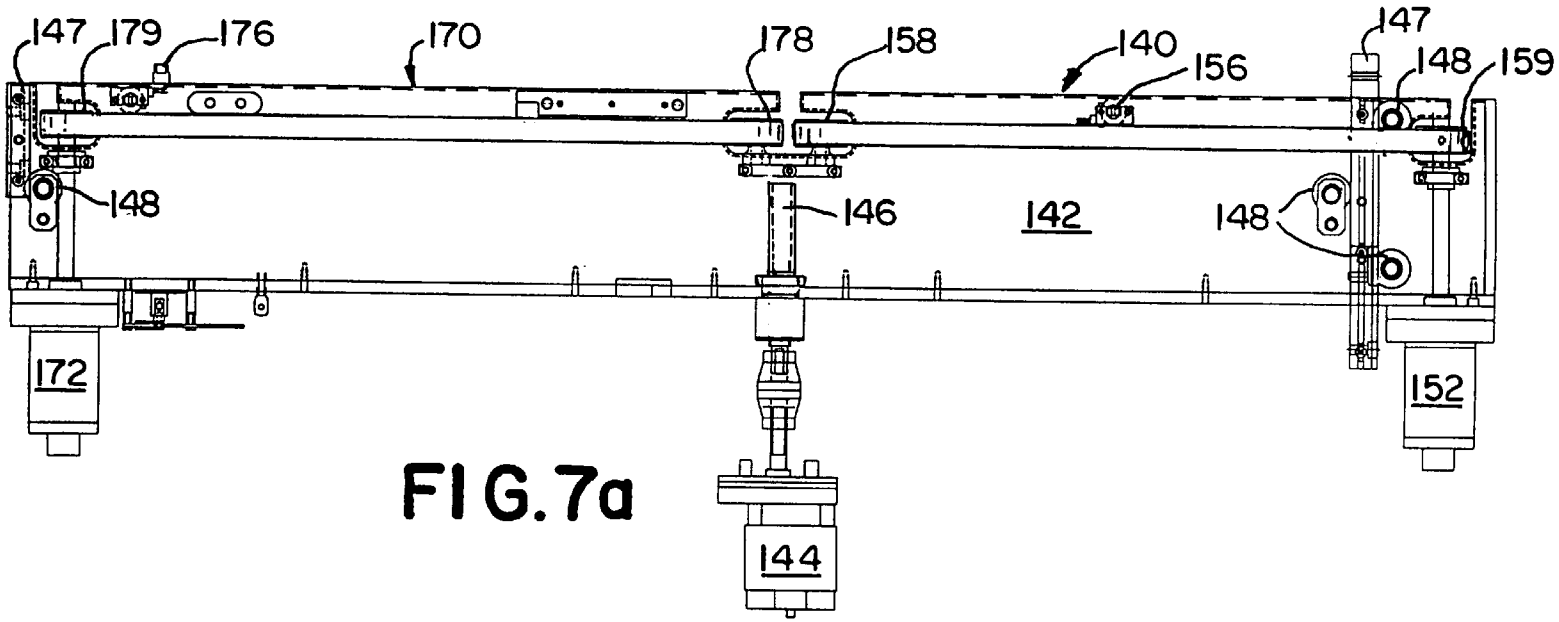
FIG. 7*a* is an enlarged front elevational view of the main transport of the device shown in FIG. 1.
Figure 8:
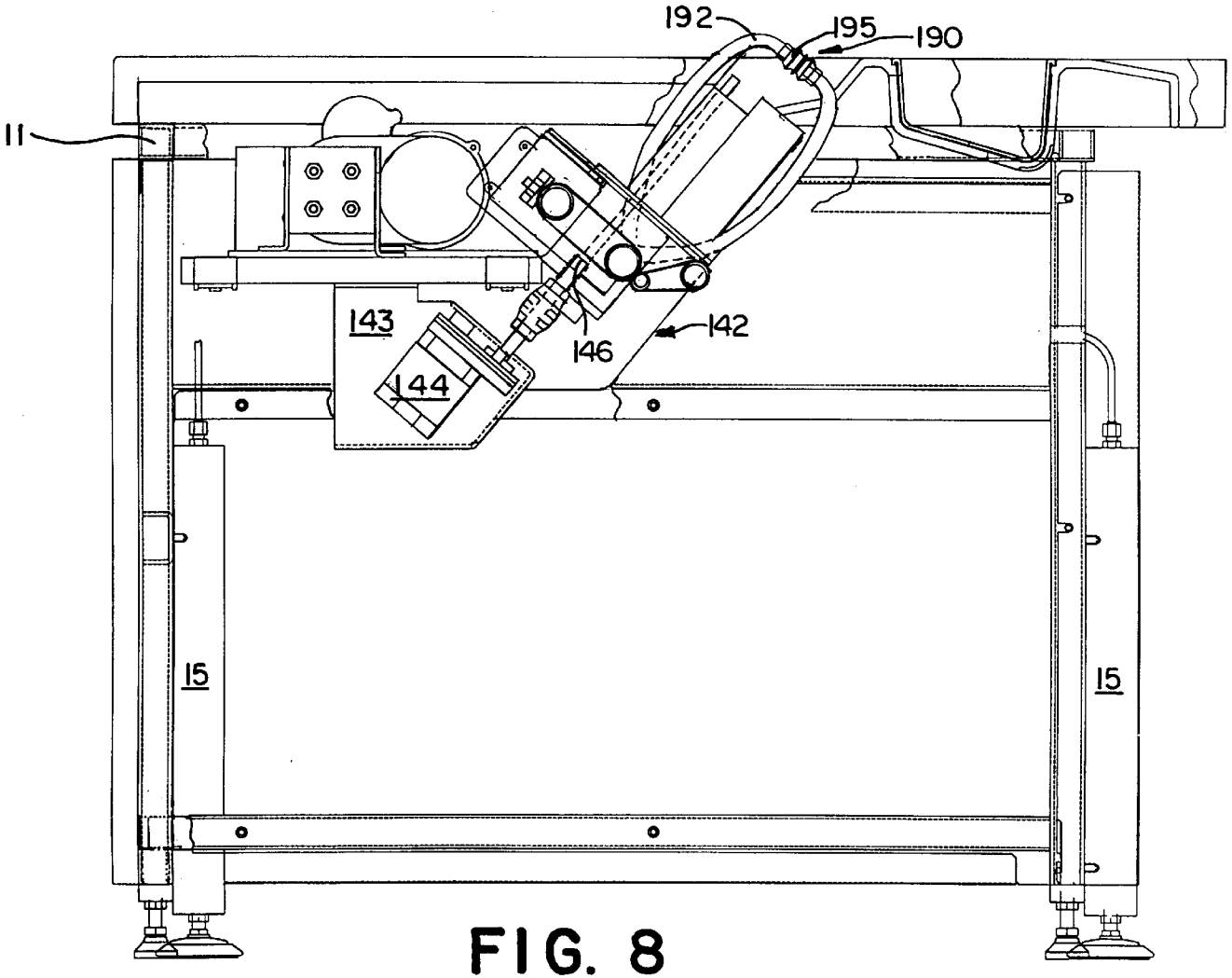
FIG. 8 is a side view of the device shown in FIG. 1, shown without the details of the input bin, feeder and shuttle.

The staging area 155 is located on the main transport 140. Referring to FIGS. 7*a* and 7*b*, the main transport includes two separate conveyors, a staging transport 150 and an extraction transport 170. The staging transport includes a staging belt 154 entrained about a drive pulley 159 and an idler pulley 158. A staging motor 152 drives the drive pulley 159, which in turn drives the staging belt 154. A plurality of idler rollers 161 are biased against the staging belt 154. The staging transport 150 engages the envelopes between the idler rollers 161 and the staging belt 154. As can be seen best in FIGS. 9 and 10, each idler roller 161 is mounted on a separate bracket 163. A spring 164 connected to each bracket biases each roller 161 toward the staging belt 154.

The staging transport 150 conveys the envelopes into the extraction transport 170. The extraction transport 170 is configured similarly to the staging transport, having a drive motor 172 that drives an extraction belt 174 around a drive pulley 179 and an idler puller 178. In addition, a plurality of idler rollers 181 are biased toward the extraction belt 174. The idler rollers 181 are mounted on brackets similar to the brackets 163 for the staging idler rollers 161 illustrated in FIGS. 9 and 10.

The main transport 140 can be fixed at a particular height. However, preferably the height of the main transport can be varied. In the present instance, the main transport 140 is mounted on a carriage 142 that rides on a pair of tracks 147*a*, 147*b*. The tracks 147*a*, 147*b* are fixedly connected to the main frame of the workstation, so that the guides do not move vertically. A plurality of guide rollers 148 guide the vertical displacement of the carriage 142 along the tracks 147*a*, 147*b*. Alternatively, and preferably, the carriage 142 includes dovetailed ways at both ends of the carriage to guide the carriage rather than the tracks 147*a*, 147*b* and the guide rollers 148. One half of each way is mounted on the frame of the workstation, with the mating halves of the ways mounted on the carriage 142.

Figure 9:
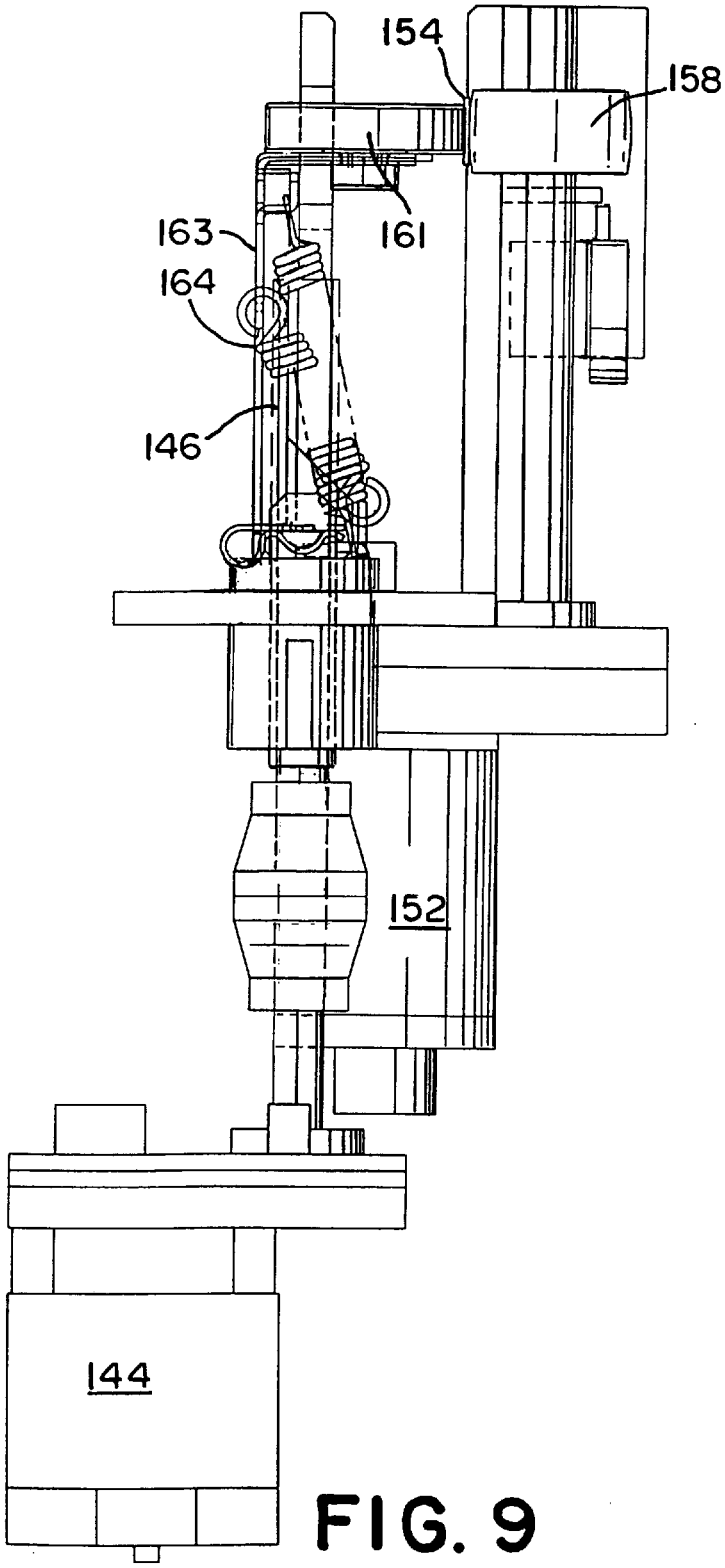
FIG. 9 is a side elevational view of the vertical drive of the main transport shown in FIG. 7*a*, shown in a fully retracted position.
Figure 10:
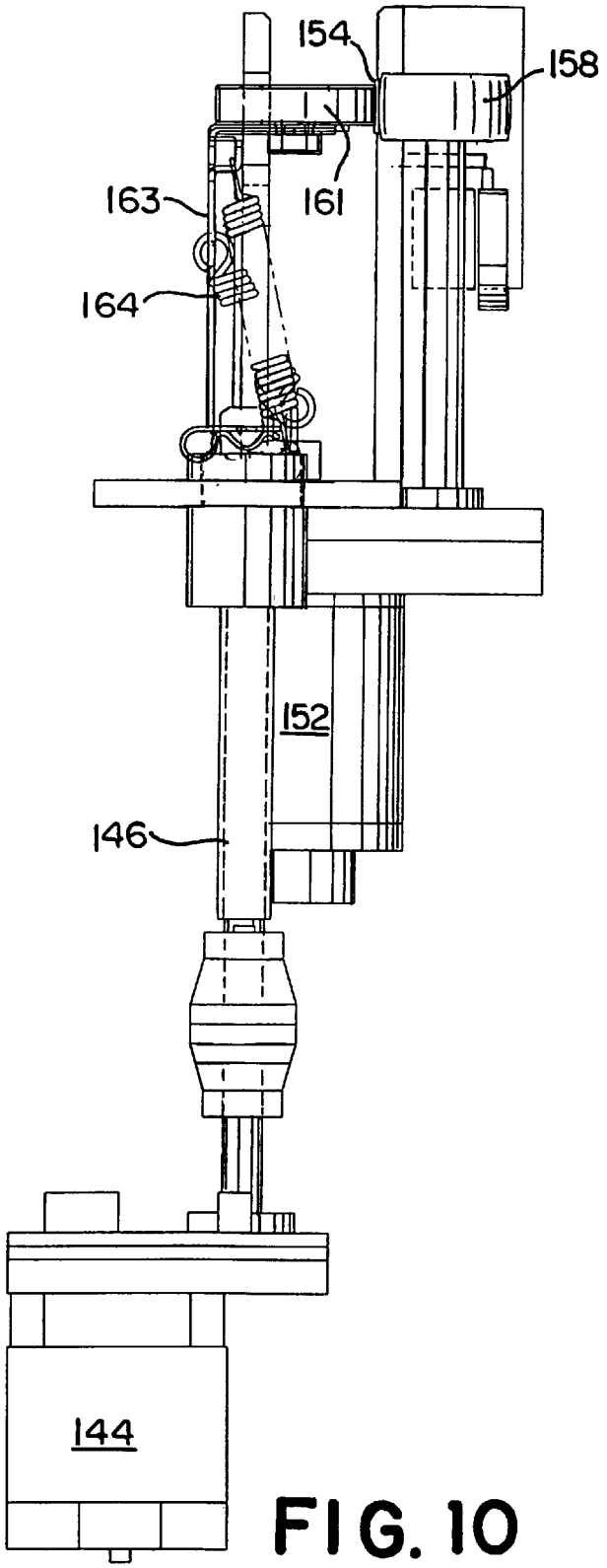
FIG. 10 is a side elevational view of the vertical drive shown in FIG. 9, shown in the fully extended position.

The carriage is vertically adjustable by a carriage motor 144 that turns a drive screw 146 that threadedly engages the carriage 142. Turning the drive screw in one direction raises the carriage relative to the frame of the workstation 10; turning the drive screw in the opposite direction lowers the carriage relative to the frame of the workstation. Referring to FIG. 9, the carriage is illustrated in a fully retracted position in which the carriage is in its lowest position. Referring to FIG. 10, the carriage is illustrated in a fully extended position in which the carriage is in its highest position.

As previously described, the upper edge of each envelope is justified by the top justifier 122 before passing through the top cutter 120 and then into the main transport. Therefore, adjusting the height of the main transport 140 adjusts the height at which the main transport 140 pinches each envelope, first between the staging belt 154 and the idler rollers 161, and then between the extraction belt 174 and the idler rollers 181. This adjustment affects the presentation of the documents in each envelope during extraction as will be discussed below. The height of the carriage 142 is fixed for an entire job by the operator before the job is processed.

Referring again to FIGS. 7*a* and 7*b*, the envelope in the staging area 155 is located with respect to the envelope's trailing edge. A sensor 128 in the top cutter 120 identifies the trailing edge of the envelope as the envelope passes through the top cutter. The staging transport 150 then transports the envelope to the staging area so that the envelope's trailing edge is at a predetermined point in the staging area. In this way, the trailing edge of each envelope in a job is stopped at the same point in the staging area regardless of the length of the envelope.

The main transport operates in two different modes: a fixed position mode and a centered-position mode. The operator selects the main transport mode prior to processing a job based on the characteristics of the mail in the job. In the fixed-position mode, the lengths of the envelopes in a job are generally fixed. In the centered-position mode, the lengths of the envelopes in a job generally varies. In both modes, the trailing edge of each envelope in a job is stopped at the same point in the verifier 200 regardless of the length of each envelope, as is discussed further below in connection with the verifier.

In the fixed-position mode, the location of each envelope in the extractor 190 is the same, and is based on the location of the envelope's trailing edge. In this way, the position that the extractor engages the envelopes in a job can be controlled to avoid contacting the envelopes on certain areas, such as on a window.

The distance from the trailing edge of the envelope in the staging area 155 to the center point of the extractor cups 195 is approximately equal to the distance from the center point of the extractor cups to the trailing edge of the envelope in the verifier 200. Since the trailing edge of the envelope in the extractor 190 is located rearward of the center point of the cups 195, the distance the envelope in the extractor must travel to the verifier is greater than the distance that the envelope in the staging area must travel to the extractor. Preferably, the controller controls the main transport 140 so that the staging transport 150 and the extraction transport 170 convey envelopes at the same rate. Therefore, to compensate for the difference in distance the envelopes travel from the staging area to the extractor and the extractor to the verifier, the extraction transport 170 is started before the staging transport 150. The pre-start time for the extraction transport 170 is equal to twice the time that it takes the extraction transport to convey the trailing edge of the envelope in the extractor 190 past the extractor cups 195.

As described above, the distance from the trailing edge of an envelope in the extractor to the center point of the extractor is preselected by the operator and is constant for an entire job. Therefore, in the fixed-position mode the pre-start time for the extraction transport is constant for a job. In addition, because the envelopes in the staging area, extractor and verifier are located based on the trailing edge of the envelopes, the overall length of each envelope does not affect the operation of the transport.

In the variable length mode, each envelope is located in the extractor 190 so that the center of the envelope is at the center of the cups 195. Therefore, the distance from the trailing edge of an envelope in the extractor to the trailing edge of the envelope in the staging area and the distance from the trailing edge of the document in the extractor to the trailing edge of the envelope in the verifier are not necessarily constant for successive envelopes as in the fixed length mode. Therefore, the pre-start time for the discharge motor is variable for each envelope. To determine the pre-start time, the length of the envelope in the extractor and staging area must be known. For this purpose, the sensor in the top cutter 128 determines the length of each envelope as the envelope passes through the top cutter. The pre-start time is then based on the time it takes to transport the envelope in the extractor a distance equal to half the length of the envelope in the extractor, plus half the length of the envelope in the staging area.

An envelope in the staging area 155 is conveyed to the extractor 190 in response to an indication that the operator has extracted the contents of the envelope in the extractor 190. The main transport 140 then conveys the envelope from the staging area 155 to the extractor 190.

Extractor

The extractor 190 operates to pull apart the faces of the edge-severed envelopes and present the contents so that an operator can easily remove the documents. After the operator removes the contents, a sensor sends a signal to the controller that the contents have been extracted. The empty envelope is then transported to the verifier 200 and another envelope is fed to the extractor 190.

Figure 11:
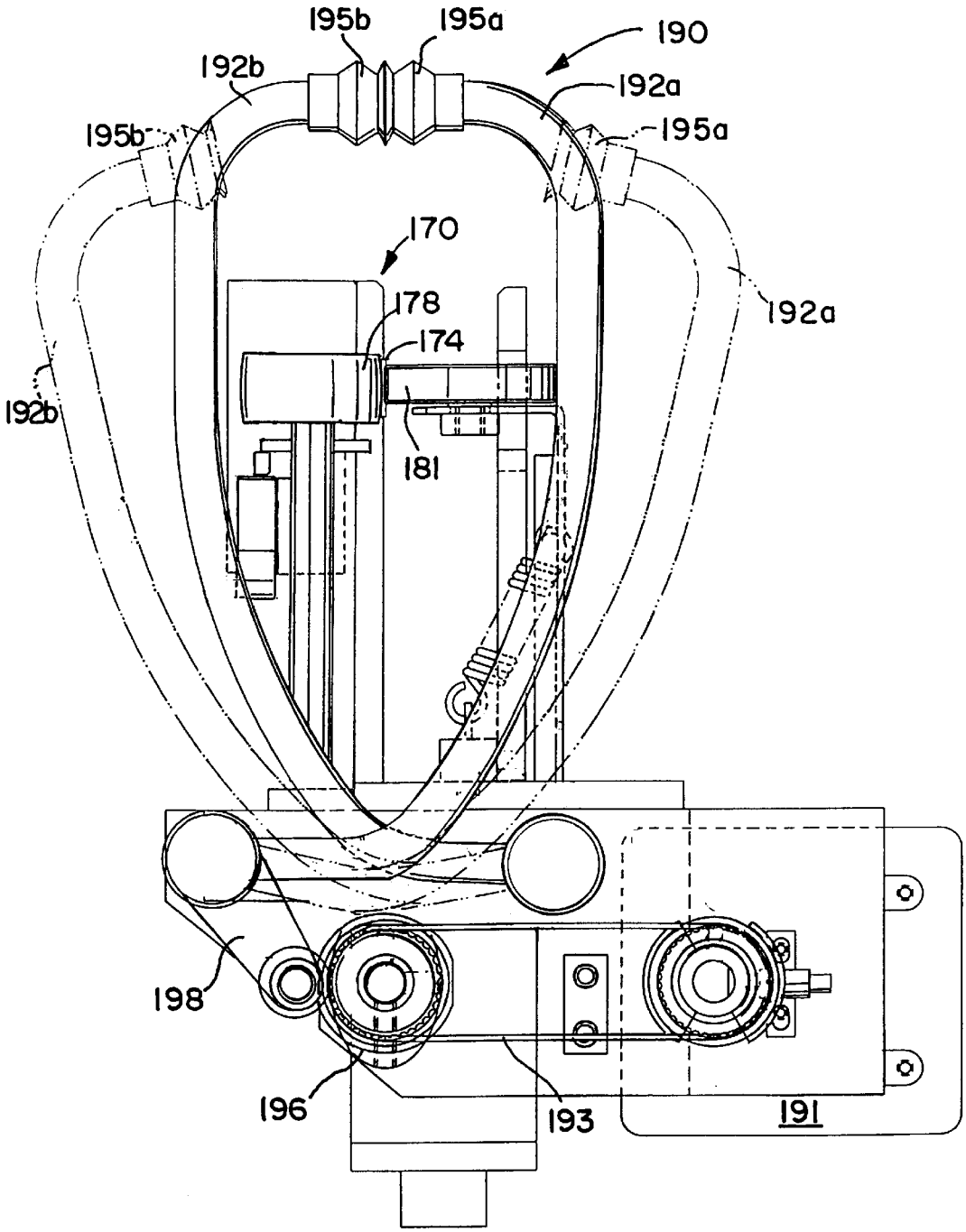
FIG. 11 is an enlarged fragmentary side elevational view of the extractor incorporated into the device shown in FIG. 1.

Referring now to FIG. 11, the extractor 190 includes a pair of opposing vacuum suction cups 195 mounted on two pivotal extractor arms 192*a*, 192*b*. The extractor suction cups 195 are similar to the feeder suction cups 72, and are connected to the same vacuum pump 225. In FIG. 11, the extractor 190 is shown in two alternative positions. In the first position, the extractor arms are pivoted away from one another. In the second position the extractor arms are pivoted toward one another.

As shown in FIGS. 7*a* and 11, the extractor 190 is positioned adjacent the main transport 140 so the extractor arms straddle the extraction belt 174 between two of the idler rollers 181. Before an envelope enters the extractor 190, the extractor arms are pivoted away from one another. When the envelope enters the extractor, the arms 192*a*, 192*b* pivot toward one another and negative pressure is supplied to the suction cups so that the suction cups engage the faces of the envelope. The arms then pivot away from one another pulling apart the faces of the envelope, which have been severed along the top edge and preferably the side edge (see FIG. 1*a*). The operator can then remove the contents of the envelope.

Preferably, the negative pressure is applied to the suction cups before the suction cups contact the envelope. Doing so reduces the likelihood that the negative pressure will bleed through the faces of the envelope and pull the contents of the envelope against the faces of the envelope when the arms are pivoted away from one another.

The pivoting motion of each extractor arm 192*a*, 192*b* is controlled by a cam 196 and a follower 198. A motor 191 drives a belt 193 that rotates the cam 196. The follower 198 is biased against the cam 196, and follows the profile of the cam as the cam rotates. One of the extractor arms 192*a* is connected to the follower, so that as the follower arm pivots, the extractor arm also pivots. A similar cam and follower not visible in the view of FIG. 11 are driven by the motor 191, and control the pivoting motion of the second extractor arm 192*b*.

In FIG. 11, the position of the cam corresponds to a position in which the extractor arms are fully closed. In this position, the follower 198 engages the minor diameter of the elliptical cam. When the extractor arms are fully open (i.e. fully pivoted away from one another), the follower 198 engages the major diameter of the elliptical cam.

The width that the extractor arms are opened when an envelope is presented to the operator can be varied for a job. The amount that the extractor arms open is controlled by the motor 191. When an envelope enters the extractor 190, the extractor arms 192*a*, 192*b* are fully opened. The motor then drives the belt 193 to rotate the cam ninety degrees so that the extractor arms are fully closed, at which point the suction cups 195 have engaged the faces of the envelope. The distance the extractor arms open an envelope to present the contents to the operator is then controlled by how much further the cam 196 is rotated after the arms are fully closed. To fully open the extractor arms, the cam is rotated another ninety degrees and then stopped. To open the extractor arms to an intermediate position, after the extractor arms are fully closed, the cam is further rotated less than ninety degrees before being stopped.

When the extractor arms are opened to an intermediate position, the force of the follower 198 against the cam 196 may cause the cam to rotate. To limit the rotation caused by the follower, the rotary motion of the motor is transmitted to the cam by a ratchet-type clutch so that the cam can only rotate in one direction.

As noted earlier, the extraction transport 170 pinches the envelope between the idler rollers 181 and the extraction belt 174. Therefore, when the extractor pulls apart the faces of the envelope, the envelope and its contents remain pinched between the idler rollers 181 and the extraction belt 174. To remove the contents, the operator must pull the contents with enough force to overcome the friction between the envelope and the contents caused by the pinching action of the extraction transport. In addition, this friction is maintained until the bottom edge of the contents is pulled past the pinch point. For this reason, generally, the lower the extraction transport 170 engages an envelope, the easier it is for an operator to remove the contents. Therefore, as explained previously, prior to processing a job it is desirable for the operator to vertically adjust the main transport 140 to the lowest point possible, which is limited by the height of the shortest envelope in a job.

The extractor 190 operates in three different modes for determining whether the contents have been extracted from the envelope: removal mode, differential mode, and content activation mode.

The simplest mode is removal mode. An optical sensor 196 is located adjacent the extractor 190 in front of the extraction transport 170 (see FIG. 1*a*). When the operator removes the contents from the envelope the contents pass over a sensor 196 and the sensor detects the presence of the contents. A signal is then sent to the controller indicating that the contents were removed. The controller then controls the main transport 140 to advance the envelope from the extractor 190 to the verifier 200. In addition, the envelope in the staging area is advanced to the extractor. The envelope is advanced from the extractor as long as some of the contents from the envelope are passed over the sensor 196, even if some of the contents remain in the envelope.

In the differential mode, an optical sensor 198 measures the thickness of the envelope immediately after the extractor arms pull apart the faces of the envelope so that the thickness of the envelope is measured before the operator extracts the contents. The optical sensor 198 continuously detects the thickness of the envelope and its contents, and compares the thickness with the initial thickness reading. If the difference in thickness is greater than a predetermined limit, a signal is sent to the controller indicating that the contents were removed from the envelope. The controller then advances the envelope to the verifier 200 and advances an envelope from the staging area 155 to the extractor. Preferably, the workstation includes a second optical sensor similar to the first sensor 198. The second sensor monitors the thickness of the envelope in the same way as the first sensor 198. When two sensors are employed, the measurements from the two sensors are averaged and compared against the predetermined limit to determine whether the contents were extracted.

If the operator removes all of the contents from the envelope, but the differential thickness is not greater than the predetermined limit, the envelope will not be advanced. In such instances the operator can advance the empty envelope by pressing an override button (not shown). Pressing the button operates to convey the empty envelope to the verifier 200 and convey an envelope from the staging area 155 to the extractor.

The content activation mode is like the differential mode in that the sensor 198 continuously detects the thickness of the envelope and its contents. However, in the content activation mode, the thickness detected by the sensor 198 is compared to a thickness standard based on the thickness of an envelope and a variation tolerance. If the sensor 198 detects a thickness that is less than the thickness standard, a signal is sent to the controller indicating that the contents were removed from the envelope. The envelope is then advanced to the verifier 200 and an envelope is conveyed to the extractor 190 from the staging area 155. Preferably, two sensors 198 are employed, both of which monitor the thickness of the envelope as described above. When two sensors are employed, the measurements from the two sensors are averaged and the average is compared against the thickness standard.

If the operator removes the contents from the envelope, but the thickness detected by the sensor is not below the thickness standard the envelope does not advance. In such instances, the operator can advance the empty envelope by pressing the override button. In response to pressing the button, the empty envelope is conveyed to the verifier 200 and an envelope is conveyed to the extractor 190 from the staging area 155.

The thickness standard used in the content activation mode can be determined in several ways. For example, the thickness standard can be based on the first envelope in a job. To do so, a job is placed in the input bin 30, and the workstation advances the lead envelope in the job to the extractor 190. The operator then removes the contents from the envelope, and the thickness sensor 198 measures the thickness of the envelope after the contents are extracted. The thickness standard is then calculated based on the thickness of the empty envelope and a predetermined variation tolerance. To advance the first envelope to the verifier 200, the operator presses the override button.

Alternatively, and preferably, the thickness standard is calculated based on the average thickness of the envelopes processed in a job. To determine the thickness standard, a job is placed into the input bin 30 and the workstation advances the first envelope in the job to the extractor 190. The operator then removes the contents from the envelope. After the operator ensures that the contents have been removed the operator presses the override button and the sensor 198 checks the thickness of the empty envelope, the thickness value is stored and the thickness standard is calculated based on the stored thickness and a predetermined tolerance. The empty envelope is then conveyed to the verifier 200 and the second envelope in the job is conveyed from the staging area 155 to the extractor 190. The operator then removes the contents of the second envelope. If the thickness of the second empty envelope is less than the standard based on the first envelope, then the second envelope is assumed to be empty. The thickness of the second envelope is stored and the thicknesses of the first two envelopes are averaged together and a new thickness standard is calculated based on the average. The second envelope is then conveyed to the verifier and the third envelope in the job is conveyed to the extractor. If, on the other hand, the thickness of the empty second envelope is greater than the standard based on the first envelope, then the operator must advance the second envelope by pressing the override button after checking to ensure the contents were removed.

As envelopes in the job are processed, each successive envelope is compared against a thickness standard based on the average thickness of the previous empty envelopes in the job. To reduce the amount of stored information, a maximum of sixteen empty envelopes are used to determine the average thickness. For example, if the 100th envelope enters the extractor and its contents are removed, the thickness of the empty 100th envelope is compared against a standard based on the average of the thicknesses of envelopes 84 through 99.

Verifier

The verifier 200 is located at the end of the extraction transport 170. The verifier checks the thickness of each envelope to ensure that all of the contents have been removed from the envelope before the envelope is discarded into the waste container 25. The verifier can use an optical sensor to check the thickness of the envelope, similar to the optical sensor used by the extractor 190. However, preferably the verifier checks the thickness of the envelope by measuring the distance between the outer surfaces of the envelope faces. To measure this distance the verifier 200 includes a rotary variable inductive transducer (RVIT).

The reference value used by the verifier 200 to check the envelopes is calculated based on the average thickness of the previous sixteen envelopes similar to the method described above for determining a thickness standard for the extractor in the content activation mode. However, in the present instance, the calculation of the reference value differs from the calculation of the extraction standard. When calculating the reference value, if an empty envelope is greater than the current reference value, the thickness of the envelope is not factored into the running average. For example, when calculating the thickness reference for the 100th envelope in a job, if the thickness of the 90th empty envelope was thicker than the reference value based on the previous sixteen envelopes, the thickness of the 90th envelope would not be included in the average used to calculate the reference value for the 100th envelope. Therefore, the reference value for the 100th envelope would be based on the average thickness of envelopes 83 through 89 and 91 through 99.

If the verifier 200 detects a thickness that is greater than the reference value, then a signal is sent to the controller indicating that the envelope in the verifier is not empty. An indicator light (not shown) is lit indicating to the operator that the envelope at the verifier should be removed and checked to ensure that all of the contents were removed. A verifier sensor 202 adjacent the RVIT detects the presence of the envelope in the verifier. Until the operator removes the envelope from the verifier, the extraction transport 170 will not advance, regardless of whether the envelope in the extractor is empty. Further, as long as the envelope remains in the verifier, the extraction transport will not advance when the override button is pressed.

If the verifier detects a thickness that is less than the reference value, a signal is sent to the controller indicating that the envelope at the verifier is empty. The controller then controls the extraction transport 170 to convey the next empty envelope from the extractor 190 to the verifier 200. When the envelope is conveyed from the extractor, the extraction transport simultaneously conveys the envelope in the verifier out the end of the main transport and into the waste container 25.

The controller controls the operation of the extraction transport 170 to ensure that the trailing edge of each envelope stops in the same position in the verifier 200 relative to the RVIT. By monitoring the trailing edge, the apparatus ensures that an envelope is not accidentally fed past the verifier and directly into the waste container when a job of variable length envelopes is processed.

Figure 12:
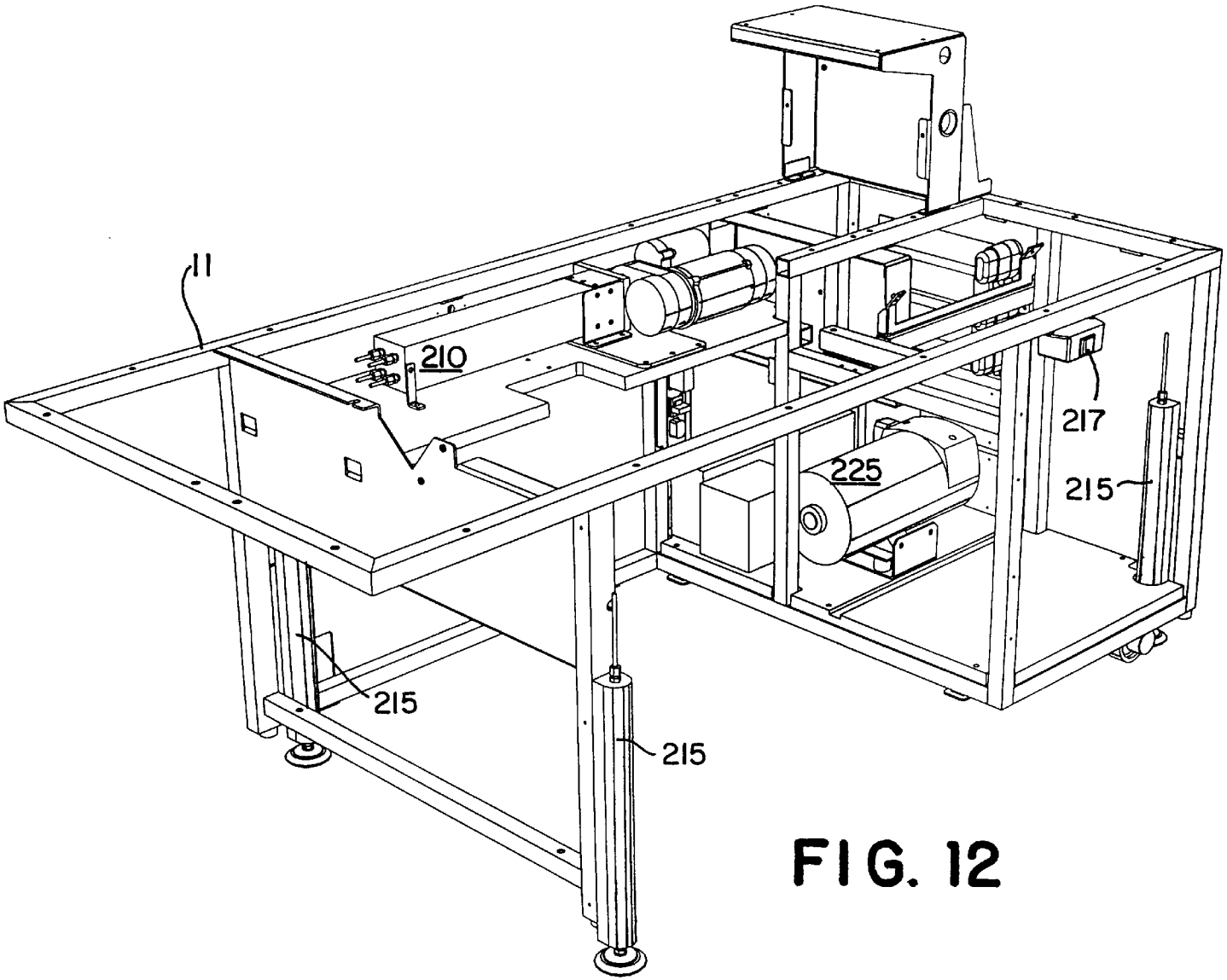
FIG. 12 is a perspective view of the frame of the device shown in FIG. 1.

Referring now to FIG. 12, preferably, the workstation 10 is mounted on hydraulic legs 215 so that the height of the workstation is adjustable. A fluid line connects each of the legs to a manifold. A hydraulic cylinder provides pressure to the manifold 210. A toggle switch 217 controls the actuation of the legs. When the operator presses the toggle in one direction, the legs 215 are extended to raise the height of the workstation. When the operator presses the toggle switch in a second direction, the legs are retracted to lower the height of the workstation. Preferably the stroke of the legs is sufficiently long to allow the height of the workstation to be adjusted so that an operator can work at the workstation either sitting or standing.

While particular embodiments of the invention have been herein illustrated and described, it is not intended to limit the invention to such disclosures, but changes and modifications may be made therein and thereto within the scope of the following claims.

What is claimed is:

1. A device for processing envelopes, comprising:

a vertical conveyor operable to convey an envelope vertically so that the upper edge of the envelope is positioned between an upper limit and a lower limit;

a cutter for cutting the top edge of the envelope;

an upper limit sensor for detecting whether the envelope upper edge is located above the upper limit and providing a signal indicating that the envelope upper edge is located above the upper limit; and a controller operable to receive the upper limit sensor signal and control the position of the vertical conveyor in response to the signal from the upper limit sensor.

2. The device of claim 1 comprising a lower limit sensor for detecting whether the envelope upper edge is located below the lower limit.

3. The device of claim 1 comprising an extractor for opening the cut envelope.

4. The device of claim 1 comprising a feeder for serially feeding the envelope to the conveyor from a stack of envelopes.

5. The device of claim 1 wherein the vertical conveyor comprises a vertically displaceable bin.

6. The device of claim 5 wherein the vertical conveyor comprises a track for vertically guiding the bin as it is displaced vertically.

7. The device of claim 1 comprising a justifier for vertically justifying the top edge of the envelope so that the top edge is located at a predefined vertical position.

8. A device for processing envelopes, comprising:

a height detector for detecting the height of an envelope;

a vertical conveyor operable to vertically adjust the position of the envelope in response to the envelope height detected by the detector; and a cutter for cutting an edge of the envelope after the envelope is positioned by the vertical conveyor.

9. The device of claim 8 comprising a justifier for vertically justifying the top edge of the envelope so that the top edge of the envelope is located at a predefined vertical position.

10. The device of claim 8 comprising an extractor for opening the cut envelope.

11. The device of claim 8 wherein the height detector comprises a sensor for detecting the top edge of the envelope as the envelope enters the vertical transport.

12. The device of claim 8 comprising a feeder for serially feeding the envelope to the conveyor from a stack of envelopes.

13. The device of claim 8 wherein the vertical conveyor comprises a vertically displaceable bin.

14. The device of claim 13 wherein the bin is constrained to substantially planar motion.

15. The device of claim 5 wherein the bin is constrained to substantially planar motion.

16. An apparatus for processing envelopes containing contents, comprising:

a. a feeder for serially feeding the envelopes into an envelope path;

b. a cutter disposed along the envelope path for severing an edge of each envelope;

c. a transport for conveying the envelopes along the envelope path wherein the transport is vertically displaceable within a plane; and d. a vertical drive operable to vertically displace the transport within the plane.

17. The device of claim 16 wherein the transport is constrained to substantially planar motion.

* * * * *